United States Patent [19]

Fusinski

[11] Patent Number: 4,827,275

[45] Date of Patent: May 2, 1989

[54] NOISE REJECTION ANTENNA SYSTEM FOR NONMETALLIC MARINE VESSELS

[76] Inventor: Richard E. Fusinski, 45581 Ledgewood, Mt. Clemens, Mich. 48044

[21] Appl. No.: 74,293

[22] Filed: Jul. 16, 1987

[51] Int. Cl.[4] ..... H01Q 1/24

[52] U.S. Cl. ..... 343/726; 343/702

[58] Field of Search ..... 343/709, 710, 726, 725, 343/729, 711, 713, 702, 724; 455/93

[56] References Cited

U.S. PATENT DOCUMENTS

| | | | |
|---|---|---|---|
| 3,824,599 | 7/1974 | Haswell | 343/852 |
| 3,987,448 | 10/1976 | Scheppman | 343/788 |
| 4,228,544 | 10/1980 | Guyton | 343/852 |
| 4,268,915 | 5/1981 | Parmet | 455/158 |
| 4,313,119 | 1/1982 | Garay et al. | 343/702 |
| 4,395,714 | 7/1983 | Takeda et al. | 343/725 |

*Primary Examiner*—William L. Sikes
*Assistant Examiner*—Doris J. Johnson
*Attorney, Agent, or Firm*—James R. Ignatowski; Remy J. VanOphem

[57] ABSTRACT

A noise attenuating antenna system for AM-FM recreational receivers having a single RF input for use on nonmetallic marine vessels or any other vehicle where electric noise presents a problem. The antenna system has at least a shielded loop antenna for receiving radio signals in the AM frequency band and a dipole antenna for receiving radio signals in the FM frequency band. An impedance matching and signal routing circuit passes the signals received by the shielded loop antenna and the dipole antenna to the recreational receiver. An amplifier, whose operation is controlled by a remotely located selection switch, passes the RF signals received by the loop antenna to the impedance matching and signal routing circuit and a signal attenuating circuit passes to ground the RF signals recevied by the dipole antenna when the selection switch is in an AM position. The amplifier is de-energized blocking the signals from the shielded loop antenna and the signal attenuating circuit generates a high impedance to ground for the RF signals received by the dipole antenna when the selector switch is in the FM position. The antenna system may also have a dipole antenna tuned for the frequency of a weather station to accommodate recreational receivers having a weather band channel.

22 Claims, 2 Drawing Sheets

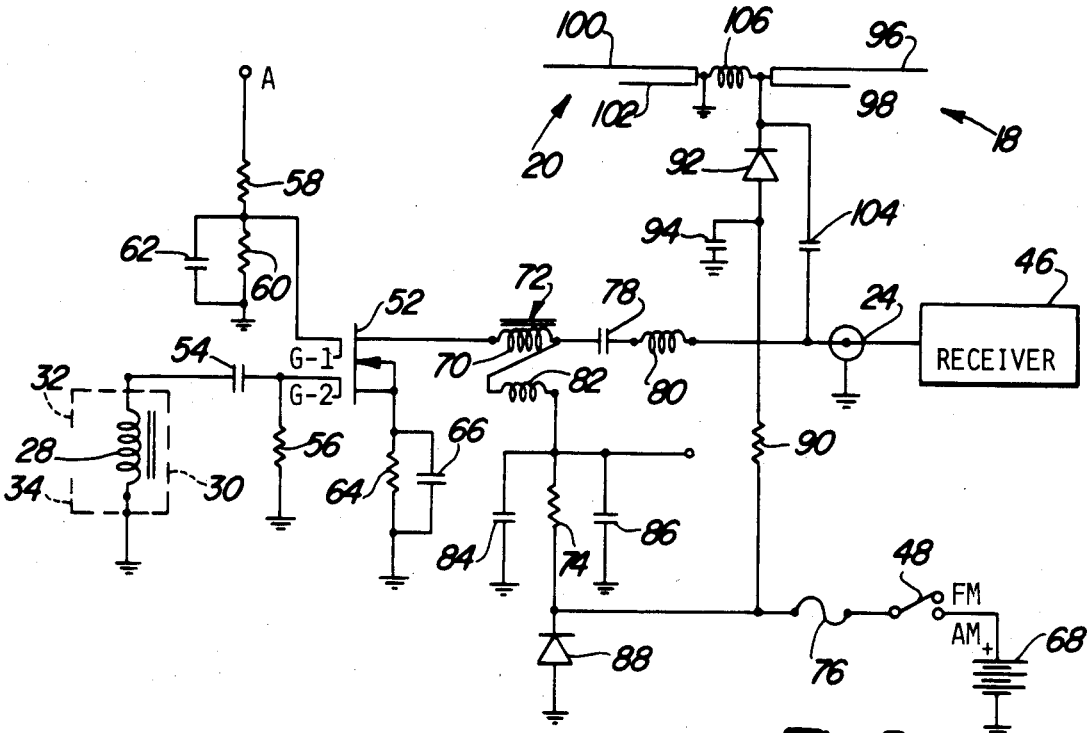
Fig-5
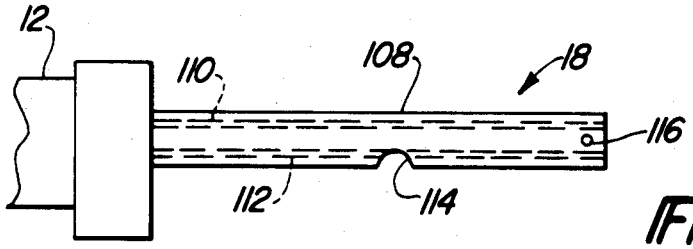
Fig-6
Fig-7
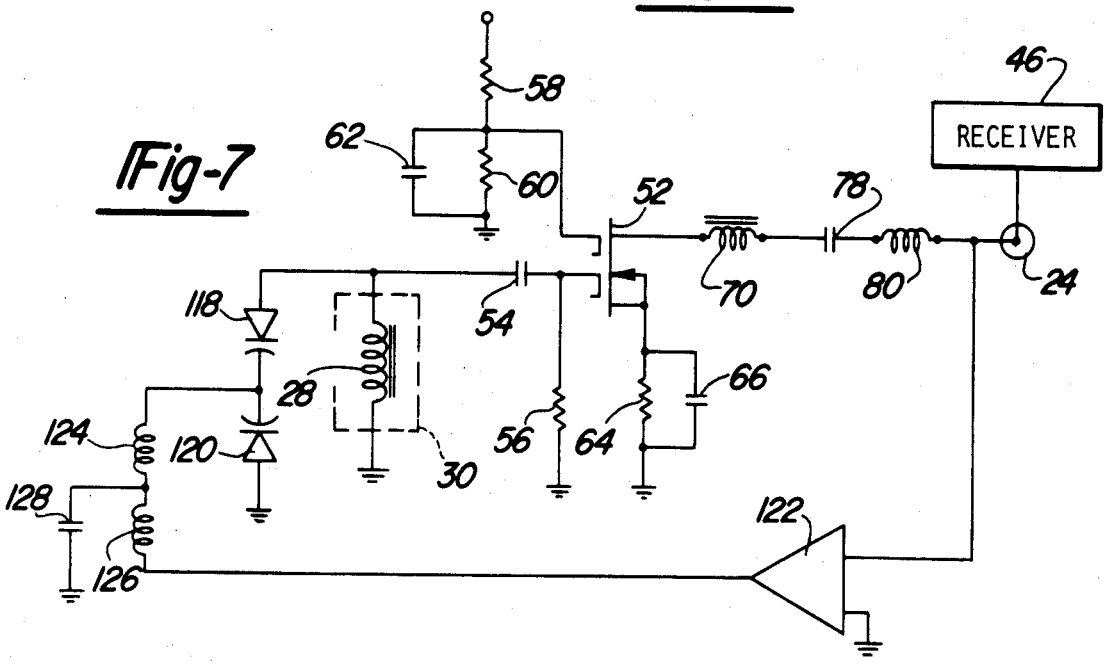

NOISE REJECTION ANTENNA SYSTEM FOR NONMETALLIC MARINE VESSELS

BACKGROUND OF INVENTION

1. Field of Invention

The invention is related to the field of antennas for receiving radio frequency electromagnetic waves and in particular to a noise rejection antenna system for recreational receivers on nonmetallic marine vessels and other vehicles.

2. Description of the Prior Art

AM-FM receivers using a single antenna input have been well developed for automobiles. However, the use of these same AM-FM receivers in nonmetallic (fiberglass) marine vessels has not been very satisfactory. The major problems encountered are the electric noises generated by the engine's ignition system, electric motors, bilge pumps, electric fans, fluorescent lights, and other similar devices found on marine vehicles. These sources produce electrical noise which is transmitted throughout the vessel and which corresponds in frequency and intensity to the radio signals desired to be received. As a result, the recreational AM-FM receiver is receiving signals from more than one source and the audio output is distorted, has excessive noise and, in general, is of a very poor quality. These same noise sources exist in automotive vehicles, but are easier to control due to the differences in the environment. Automotive manufacturers recognized these problems years ago and have taken a total system approach to remove or suppress most of the noise sources at their origin. In addition, the metal body of the automotive vehicle is an effective electric shield between the noise sources under the hood and in the passenger compartment and the externally mounted antenna.

On nonmetallic marine vessels, the wood flooring and the nonmetallic hulls, such as those made from wood, fiberglass or other plastic materials, are transparent to the electrical noises generated by these sources and the effective electrical shield inherent in the automotive vehicle is nonexistent. As a result, the recreational AM-FM stereo receivers developed for automotive vehicles perform poorly in nonmetallic marine vessels.

The antenna is an important component in determining the performance qualities of the recreational receivers mounted on the marine vessels. A poor antenna can result in a well designed (expensive) recreational receiver having poor performance, while a good antenna can significantly improve the performance of a less expensive recreational receiver.

In automotive vehicles, because of the insulation of the antenna from the sources of noise, a single antenna will normally have adequate reception capabilities for the recreational receiver. The most prominent antenna used in the automotive vehicle is the vertical rod or whip antenna. However, dipole antennas mounted in the windshields of automotive vehicles have also been used extensively. Currently, most automotive vehicle recreational receiver manufacturers utilize a compromise antenna system by using an antenna tuned to the frequency range of the FM radio signals. This antenna also serves as an AM antenna; however, its sensitivity in the AM frequency range is relatively poor. To compensate for the poor sensitivity in the AM frequency range, the manufacturers of the receivers provide additional gain in the RF stages of the receiver.

Preferably, the receiver should have one antenna specifically tuned for the AM radio signal frequency range and another specifically tuned for the FM radio signal frequency range. However, this arrangement alone will not solve the noise problems encountered on nonmetallic marine vessels.

The use of multiple antennas in conjunction with recreational receivers is addressed by Ito, et al., in U.S. Pat. No. 4,193,076. Ito discloses a system for coupling an external rod (whip) antenna with a loop antenna mounted on a magnetic core. In the system taught by Ito, et al., both antennas are tuned to the same frequency range. In a similar manner Garay, et al., in U.S. Pat. No. 4,313,119, disclosed a dual mode transceiver antenna having a low profile loop antenna and a high efficiency dipole antenna. Similarly, Silverstein, in U.S. Pat. No. 3,121,229, discloses an underwater antenna system for a submarine responsive to both the magnetic and electric field components.

Neither Ito, et al., Garay, et al., or Silverstein address the problem of having dual antennas tuned to different frequencies feeding a single antenna input to a recreational receiver. Nor do they address the problems associated with the attenuation of the radiated electrical noises originating from the numerous unshielded sources on a nonmetallic marine vessel.

SUMMARY OF THE INVENTION

The invention is a noise attenuating antenna system for AM-FM recreational receivers particularly applicable to nonmetallic marine vessels. The antenna system has a first antenna tuned to the frequency range of the AM broadcast band and a second antenna tuned to the frequency range of the FM broadcast band. An amplifier amplifies the radio frequency signals received by the first antenna and a signal attenuator circuit passes to ground the radio frequency signals received by the second antenna. An impedance matching and routing circuit routes the radio frequency signals received from the amplifier and the signal attenuating circuit to the recreational receiver. A function switch, switchable between an AM position and an FM position, actuates the amplifier to pass the radio frequency signals received by the loop antenna to the impedance matching and signal routing circuit and actuates the signal attenuating circuit to pass to ground the radio frequency signals received by the second antenna when the function switch is in the AM position. The function switch also deactuates the amplifier blocking the radio frequency signals received by the first antenna, and deactuates the signal attenuating circuit generating a high impedance to ground for the signals received by the dipole antenna when the function switch is in the FM position.

In the preferred embodiment, the antenna system also has a second dipole antenna tuned to the frequency on which weather information is broadcast to accommodate recreational receivers having a weather channel.

An object of the invention is to improve the reception of AM and FM signals on nonmetallic marine vessels. Another object of the invention is to provide at least two antennas, one for the AM frequency band and a second for the FM frequency band, and the capability of switching between them. Another object of the invention is to ground the signals received by the FM antenna when the AM antenna is being used to maximize the attenuation of the electrical field noise. Another object of the invention is an antenna system which may be mounted at a remote location away from the engine and other sources of electrical noise on the marine vessel. These and other objects of the invention will become more apparent from a reading of the detailed description of the invention in conjunction with the appended drawings.

BRIEF DESCRIPTION OF THE DRAWINGS

FIG. 5 is a circuit diagram of the first embodiment of the noise attenuating antenna system;

FIG. 6 is a partial view showing the details of one segment of the dipole antenna; and FIG. 7 is a partial circuit diagram showing the details of an alternate embodiment of the AM loop antenna.

DETAILED DESCRIPTION OF THE PREFERRED EMBODIMENT

Figure 1:
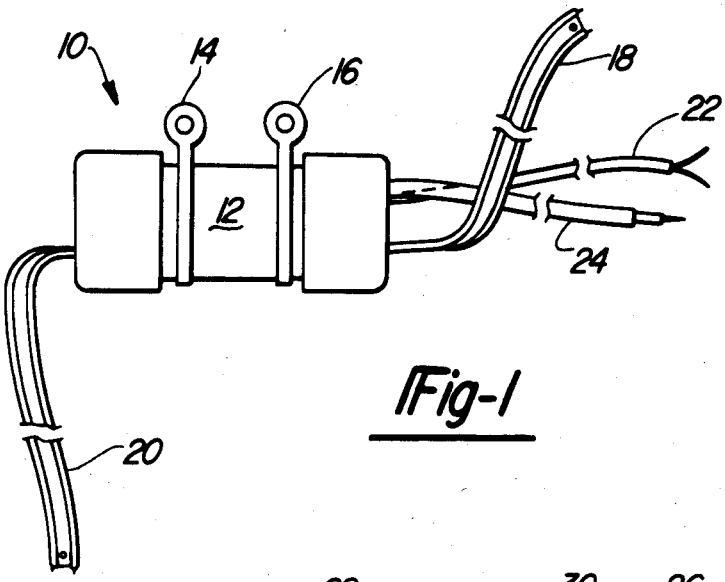
FIG. 1 illustrates the external configuration of the noise attenuating antenna system.

The external configuration of a noise rejection antenna system, indicated generally by reference numeral 10, is shown in FIG. 1. The noise rejection antenna system 10 is enclosed in a structural plastic housing 12 having a pair of mounting straps 14 and 16 which permit the antenna system to be mounted to the walls of a marine vessel or other vehicle. In the embodiment illustrated in FIG. 1 the housing is mounted in the horizontal position as shown to optimize the reception of the AM radio frequency signals. Extending from the opposite ends of the housing 12, are the first and second segments 18 and 20, respectively, of dual half-wave dipole antenna. The dual dipole antenna embody an FM dipole antenna tuned to receive RF (radio frequency) signals in the FM (frequency modulated) frequency band ranging from 88 to 108 mHz and a WX (weather band) dipole antenna optimized to receive RF weather signals transmitted at 162.55 mHz. An input lead 22 carries the function signals which control the operation of the noise rejection antenna system 10 and a coaxial output cable 24 which connects the noise rejection antenna system to a receiver.

Figure 2:
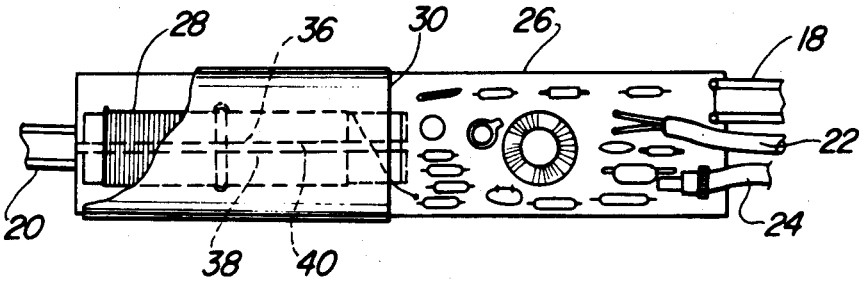
FIG. 2 is a top view of the circuit board showing the location of the major components.
Figure 3:
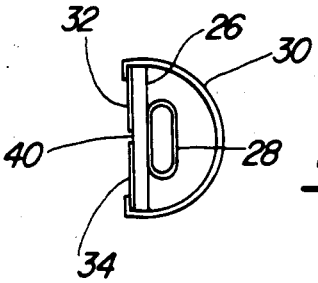
FIG. 3 is an end view of the circuit board showing the electric shielding of the loop antenna.

The housing 12 encloses a circuit board 26, the details of which are shown in FIGS. 2 and 3. Referring to FIG. 2, an AM (amplitude modulated) loop antenna 28 is mounted at one end of the circuit board 26 while the first segment 18 of the dual dipole antenna, the input lead 22 and the coaxial output cable 24 are connected to the other end of the circuit board. The AM loop antenna 28 is wound on a magnetic core and is primarily responsive to the H (magnetic) field of the transmitted AM signal. The AM loop antenna 28 is of a conventional design which is used in a variety of commercially available portable as well as recreational receivers for RF signals transmitted in the AM frequency band. For maximum sensitivity, the loop antenna is mounted with the magnetic core in a horizontal position which is parallel to the H (magnetic) field of the transmitted electromagnetic radio waves.

One side of the AM loop antenna 28 is shielded with a copper C-shaped shield 30, as more clearly shown in FIG. 3. The other side of the AM loop antenna is enclosed by a pair of flat electrodes 32 and 34 printed or otherwise formed on the underside of the circuit board 26. The flat electrodes 32 and 34 extend under the entire length of the AM loop antenna 28, as indicated by dashed lines 36 and 38 in FIG. 2. The C-shaped shield 30 is fixedly attached to the flat electrodes 32 and 34 along their lateral edges by soldering or any other means known in the art which will provide a good electrical connection between these elements. The C-shaped shield 30 and the flat electrodes 32 and 34 form an electric shield about the AM loop antenna 28 isolating it from the E (electric) fields being emitted by the various sources of electrical noise as well as the electrical signals reradiated by metal objects throughout the nonmetallic marine vessel. The flat electrodes 32 and 34 are separated along their length by a small space 40 which allows the AM loop antenna to receive and respond to the H (magnetic) field of the AM radio frequency signals. The wire leads of the second segment 20 of the dual dipole antenna are fixedly attached to one or both of the flat electrodes 32 and 34. Both wire leads of the second segment 20 may be attached to the same flat electrode 32 or 34 or one lead may be attached to one of the flat electrodes and the other lead attached to the other flat electrode.

Figure 4:
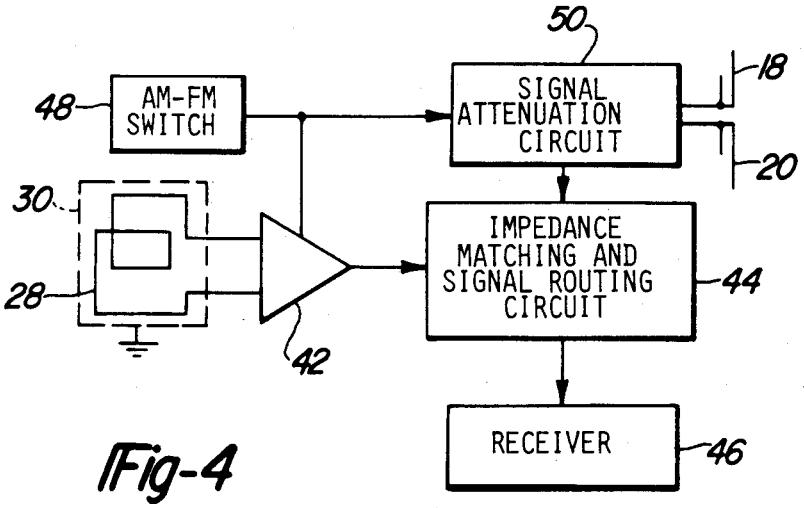
FIG. 4 is a block diagram of the noise attenuating antenna system.

A block diagram of the electric circuit mounted on the circuit board 26 is shown in FIG. 4. The output of the AM loop antenna 28 is amplified by an amplifier 42, the output of which is received by an impedance matching and signal routing circuit 44. The amplifier 42 also functions as an electronic switch to pass the RF signals received by the AM loop antenna 28 to the impedance matching and signal routing circuit 44. The impedance matching and signal routing circuit 44 passes the received AM signal to a receiver 46 via the coaxial output cable 24. An AM-FM switch 48 controls the operation of the amplifier 42 and a signal attenuation circuit 50.

When the AM-FM switch 48 is in the AM position, the amplifier 42 and the signal attenuation circuit 50 are energized. In the energized state, the amplifier 42 will amplify the RF signal received by the AM loop antenna 28 and pass it to the impedance matching and signal routing circuit 44. When the signal attenuation circuit 50 is energized it will pass to ground the RF signals received by the FM and weather band dipole antennas formed by the first and second segments 18 and 20, respectively, of the dual dipole antenna.

When the AM-FM switch 48 is in the FM position the amplifier 42 is de-energized which inhibits the RF signals received from the AM loop antenna 28 from being passed to the impedance matching and signal routing circuit 44. Also when the AM-FM switch 48 is in the FM position the signal attenuation circuit 50 is de-energized, providing a high impedance path to ground for the RF signals received by the FM and weather band dipole antennas and allows these RF signals to be passed to the impedance matching and signal routing circuit 44.

The impedance matching and signal routing circuit 44 matches the impedance of either antenna with the output impedance of the receiver 46 to optimize the sensitivity of the receiver 46 to the received RF signals and routes the RF signals received from either the amplifier 42 or the signal attenuation circuit 50 to the receiver 46.

The circuit diagram shown in FIG. 5 discloses the details of the amplifier 42, the AM-FM switch 48, the impedance matching and signal routing circuit 44, and the signal attenuation circuit 50. Referring to FIG. 5, one end of the AM loop antenna 28 is connected to ground and the other end is connected to a second gate (G-2) of a dual gate FET transistor 52 through a capacitor 54. The junction between the capacitor 54 and the second gate of the FET transistor 52 is connected to ground through a resistor 56. A voltage divider consisting of series connected resistors 58 and 60 generates at their junction a bias voltage which is applied to a first gate (G-1) of the dual gate FET transistor 52. A filter capacitor 62 is connected in parallel with the resistor 60. The voltage divider receives a filtered voltage "A" from the impedance matching and signal routing circuit 44, as shall be explained hereinafter.

The source of the FET transistor 52 is connected to ground through a resistor 64 and a filter capacitor 66. The drain of the FET transistor 52 is connected to the source of electrical power 68, illustrated as a battery, through the first winding 70 of a broad band pass toroid transformer 72, resistor 74, fuse 76, and the AM-FM switch 48 which is illustrated as a single pole, single throw switch. The amplifier 42 shown in FIG. 3 includes the FET transistor 52 and its associated circuitry consisting of the resistors 56, 58, 60 and 64 and the capacitors 54, 62 and 66. The opposite end of the first winding 70 of the toroid transformer 72 is connected to the center conductor of the coaxial output cable 24 through a capacitor 78 and an RF choke 80. The capacitor 78 and the RF choke 80 form a filter which offers a low impedance to RF signals in the AM frequency range and a high impedance to RF signals in the FM and weather band frequency ranges.

The opposite end of the first winding 70 is also connected to a second winding 82 of the toroid transformer 72 and to the source of electrical power 68 through the resistor 74, the fuse 76 and the AM-FM switch 48, as previously described. A pair of decoupling capacitors 84 and 86 are connected between ground and the junction formed between the second winding 82 of the toroid transformer 72 and the resistor 74 to remove stray RF signals and electrical noise from being transmitted to the coaxial output cable 24. The filtered voltage "A" applied to the voltage divider network connected to the first gate of the FET transistor 52 is generated at the junction between the second winding 82 of the toroid transformer and the resistor 74. One of the decoupling capacitors 84 and 86 forms a low impedance path to ground for high frequency signals while the other decoupling capacitor forms a low impedance to ground for the lower frequency signals appearing at the junction. A diode 88 is connected to the junction between the resistor 74 and the fuse 76 to protect the FET transistor 52 in the event polarity of the voltage applied to the AM-FM switch 48 from the source of electrical power 68 is reversed.

The signal attenuation circuit 50 has a resistor 90 connected between the anode of a PIN diode 92 and the junction between the resistor 74 and the fuse 76. The anode of the PIN diode 92 is also coupled to ground through a bypass capacitor 94 which offers a low impedance to ground for the FM and weather band signals received by the first segment 18 of the dual dipole antenna. As shown, the first segment 18 of the dual dipole antenna includes an FM element 96 and a weather band element 98. In a like manner, the second segment 20 of the dual dipole antenna also has an FM element 100 and a weather band element 102. The lengths of the FM elements 96 and 100, which together make up a one-half wave FM dipole antenna are selected to optimize the reception of the signals in the FM frequency range and the lengths of the weather band elements 98 and 102, which make up a one-half wave weather band dipole antenna, are selected to optimize the reception of the weather band signals, as is known in the art.

The FM element 96 and weather band element 98 of the first segment 18 of the dual dipole antenna are connected to each other at their central extremities, to the cathode of the PIN diode 92 and to the center conductor of the coaxial output cable 24 through a coupling capacitor 104. The coupling capacitor 104 is part of the impedance matching and signal routing circuit 44 shown in FIG. 4. The FM element 100 and the weather band element 102 of the second segment 20 of the dual dipole antenna are also connected together at their central extremities and to the cathode of the PIN diode 92 through an RF choke 106 which has a high impedance in the frequency range of the FM and weather band signals. The central extremities of the FM and weather band elements 100 and 102 are also connected directly to ground.

The signal attenuation circuit 50, shown in FIG. 4, consists of the RF choke 106, the PIN diode 92, the resistor 90, and the bypass capacitor 94. The impedance matching and signal routing circuit 44 shown in FIG. 4 consists of the toroid transformer 72, the coupling capacitors 78 and 104, the decoupling capacitors 84 and 86, the resistor 74 and the diode 88.

The operation of the noise rejection antenna system is as follows: the placing of the AM-FM switch 48 in the AM position applies electrical power from the source of electrical power 68 to the drain of the FET transistor 52 and generates a forward biasing potential at the first gate G-1 through the voltage divider network consisting of the resistors 58 and 60. This energizes the FET transistor 52 to amplify the AM signals received by the loop antenna 28 which are passed to the receiver 46 through the first winding 70 of the toroid transformer 72, the coupling capacitor 78, the RF choke 80 and the coaxial output cable 24.

The setting of the AM-FM switch 48 to the AM position also forward biases the PIN diode 92, placing it in a conductive state. In the conductive state, the PIN diode 92 will preferentially pass the RF and noise signals received by the first segment 18 of the dual dipole antenna to ground through the capacitor 94. The values of the bypass capacitor 94 and the coupling capacitor 104 are selected so that when the PIN diode 92 is conductive the impedance to ground through the PIN diode 92 and bypass capacitor 94 is lower than the impedance path to the center conductor of the coaxial output cable 24 through the FM coupling capacitor 104. This effectively grounds out all of the unwanted E field signals and electrical noise which would have otherwise been passed to the receiver 46 through the coupling capacitor 104 and the coaxial output cable 24.

Placing the AM-FM switch 48 in the FM position removes all electrical power from the FET transistor 52 and from the anode of the PIN diode 92. Removal of the electrical power to the FET transistor 52 renders it nonconductive, effectively blocking all of the RF signals received by the AM loop antenna 28. The removal of the positive potential from the anode of the PIN diode 92 renders it nonconductive, which terminates the grounding of the RF signals received by the FM and weather band elements 96 and 98 of the first segment 18 of the dual dipole antenna. The signals received by these elements are then passed to the receiver 46 through the FM coupling capacitor 104 and the coaxial output cable 24. Dissipation of these FM and weather band signals in the impedance matching and signal routing circuit is prevented by the capacitor 78 and the RF choke 80 which together form a high impedance to the RF signals in the FM and weather band frequency range. The RF choke 106 connected between the first and second halves of the dual dipole antenna also presents a high impedance to ground for the received FM and weather band signals.

The details of the structure of the first segment 18 of the dipole antenna are shown in FIG. 6. The first segment of the dual dipole antenna consists of a length of parallel wire T.V. antenna lead-in cable 108, such as is commonly used between domestic television receivers and remotely located antennas. The length of the lead-in cable 108 is selected for the optimal reception of FM signals. The lead-in cable 108 has a first internal metal wire 110 which functions as the FM element 96 shown in FIG. 5 and a second internal wire 112 which functions as the weather band element 98. A small notch 114 cut into the lead-in cable 108 severs the second internal wire 112 at a length which optimizes it for the reception of RF signals in the frequency range of the weather band signal. A hole 116 may be provided near the end of the lead-in cable 108 to facilitate the mounting of the dual dipole antenna in a vertical position as shown in FIG. 1. The structure of the second segment of the dual dipole antenna 20 is similar to the structure of the first segment 18 and it need not be described in detail.

An alternate embodiment of the noise rejection antenna system in which the AM loop antenna 28 is tuned to the same AM frequency as the receiver 46 is shown in FIG. 7. Only that portion of the circuit which is involved with the changes of the alternate embodiment are shown in FIG. 7. The remainder of the circuit which is not changed is the same as shown in FIG. 5. Referring to FIG. 7, it is assumed that the receiver 46 is of the type in which a DC signal is generated which is indicative of the AM frequency to which it is tuned. In the receiver 46 this signal is applied to one or more varactors to tune its input RF stages to the desired frequency. As is known, the capacitance of the varactors will change as a function of the applied voltage and, therefore, can be used to change the frequency to which an LC (inductance and capacitance) circuit is tuned. This same concept can be used to tune the loop antenna 28 to the same frequency to which the receiver is tuned.

The receiver 46 couples a DC tuning signal having a voltage indicative of the frequency to which it is tuned to the center conductor of the coaxial output cable 24. The DC tuning signal is applied to the cathode of a pair of face-to-face varactors 118 and 120 through a non-inverting operational amplifier 122 and a pair of serially connected RF chokes 124 and 126. A bypass capacitor 128 connected between ground and the junction of the serially connected RF chokes 124 and 126 decouples the signals appearing on the lines carrying the DC tuning signal from the AM loop antenna 28 and the signals generated by the tuned loop antenna from being propagated back to the receiver.

The anode of the varactor 118 is connected to ground through the AM loop antenna 28 while the anode of the varactor 120 is connected directly to ground. The varactors 118 and 120 and the AM loop antenna 28 form an LC tuned circuit which is capable of oscillating at the same frequency as the frequency to which the receiver 46 is tuned. The oscillating frequency of the LC circuit formed by the AM loop antenna 28 and the varactors 118 and 120 can be controlled by adjusting the gain of the operational amplifier 122. As would be apparent to those skilled in the art, by appropriate selection of the capacitance characteristics of the varactors 118 and 120 and the inductance of the AM loop antenna 28, the operational amplifier 122 may be omitted from the circuit and the DC tuning signal generated by the receiver 46 may be applied directly to the cathodes of the varactors 118 and 120.

The advantages of the noise rejection antenna system are as follows:

1. The antenna system uses two different antennas, a shielded magnetic loop antenna for the reception of AM signals and a tuned set of dipole antennas for the FM and weather band signals.

2. The signals transmitted to the receivers are from either the AM antenna or the FM antenna, but not both at the same time.

3. The signals received by the antenna currently not being used are shunted to ground to eliminate all extraneous noises and unwanted RF signals from being passed to the receiver.

4. The noise reduction antenna system is small and can be located on the boat or vehicle at remote locations away from the strong electrical and magnetic fields and the electric noises generated proximate the engines, electrical motors, and the dashboard area.

What is claimed is:

1. A noise attenuating antenna system connectable to the antenna input of an AM-FM recreational receiver having a single antenna input comprising:

a first antenna sensitive to RF signals in the AM radio frequency band;

a second antenna sensitive to the RF signals in the FM frequency band;

amplifier means for amplifying the RF signals received by said first antenna;

signal attenuation means for attenuating the RF signals received by said second antenna;

impedance matching and signal routing means for routing the RF signals received from said amplifier means and said signal attenuation means to said single antenna input of said AM-FM receiver and for matching the impedance of said received RF signals to the input impedance of said AM-FM receiver; and switch means switchable between an AM position and an FM position, said switch means in said AM position actuating said amplifier means to pass the RF signals received from said first antenna to said impedance matching and signal routing means and actuating said signal attenuation means to pass to ground the RF signals received by said second antenna, said switch means in said FM position deactuating said amplifier means blocking the signals received by said first antenna and deactuating said signal attenuation means permitting the RF signals received by said second antenna to be passed to said impedance matching and signal routing means.

2. The antenna system of claim 1 wherein said first antenna is a loop antenna.

3. The antenna system of claim 2 wherein said loop antenna has a magnetic core.

4. The antenna system of claim 3 wherein said loop antenna has a shield for shielding said loop antenna from electric fields.

5. The antenna system of claim 1 wherein said first antenna is an electrically shielded loop antenna horizontally disposed to optimize its response to the magnetic field of AM signals being received.

6. The antenna system of claim 1 wherein said second antenna is a dipole antenna tuned to FM frequency band.

7. The antenna system of claim 6 wherein weather information is transmitted on a predetermined RF frequency and said AM-FM receiver also includes a weather band channel tuned to said predetermined RF frequency, said antenna system further comprising a second dipole antenna tuned to said predetermined RF frequency.

8. The antenna system of claim 4 wherein said second antenna is a dipole antenna tuned to the RF signals in the FM frequency band.

9. The antenna system of claim 8 wherein weather information is transmitted on a predetermined RF frequency and said AM-FM receiver includes a weather channel tuned to said predetermined RF frequency, said antenna system further comprising a second dipole antenna tuned to said predetermined RF frequency.

10. The antenna system of claim 1 wherein said switch means provides electrical power to said amplifier means and said signal attenuation means in said AM position and removes electrical power from said amplifier means and said signal attenuation means in said FM position.

11. The antenna system of claim 10 wherein said amplifier means is a FET transistor having a gate connected to said first antenna, and a drain connected to said switch means.

12. The antenna system of claim 1 wherein said signal attenuation means comprises:

a diode having a cathode connected to said second antenna and an anode;

a resistor connecting said anode to said switch means; and a bypass capacitor connected between said anode and ground for shunting to ground the RF signals received by said second antenna when said diode is forward biased by the electrical power received from said switch means in said AM position.

13. The antenna system of claim 12 wherein said second antenna is at least one dipole antenna having a first element connected to ground and a second element connected to said cathode of said diode, said signal attenuation means further having an RF choke connected between said cathode of said diode and ground, said RF choke having a high impedance in the FM band frequency range and a low direct current impedance to ground.

14. The antenna system of claim 1 wherein said impedance matching and signal routing means comprises:

a coaxial cable having an output end connectable to said AM-FM receiver and an input end;

a first coupling capacitor connected between said input end of said coaxial cable and said second antenna;

a second coupling capacitor having one electrode connected to the output of said amplifier means and a second electrode; and an RF choke having a high impedance to RF signals in the FM frequency range and a low impedance to RF signals in the AM frequency range connecting said second electrode of said second coupling capacitor to said input end of said coaxial cable.

15. The antenna system of claim 14 further comprising a toroid transformer having a first winding connected between the output of said amplifier means and said first electrode of said second coupling capacitor and a second winding connected between the first electrode of said second coupling capacitor and said switch means.

16. The antenna system of claim 15 wherein said amplifier means is a FET transistor having a drain electrode connected to said switch means through said first and second windings of said toroid transformer.

17. The antenna system of claim 4 wherein said AM-FM receiver generates a tuning signal having a value corresponding to the frequency to which the AM-FM receiver is tuned, said loop antenna further including at least one varactor diode connected in parallel with said loop antenna to form a tuned antenna circuit, said at least one varactor diode being responsive to the value of said tuning signal to tune said antenna circuit to the same frequency to which said AM-FM receiver is tuned.

18. The antenna system of claim 1 wherein said AM-FM receiver generates a tuning signal having a value indicative of the frequency to which is tuned, said first antenna further including means responsive to said tuning signal to tune said first antenna to the same frequency to which said AM-FM receiver to tuned.

19. A noise attenuating antenna system connectable to the input of an AM-FM recreational receiver having a single antenna input comprising:

a first antenna responsive to radio frequency signals in the AM transmission band;

a second antenna responsive to radio frequency signals in the FM transmission band;

an AM-FM switch having a first position corresponding to AM ratio station frequencies and a second position corresponding FM radio station frequencies;

an impedance matching and signal routing circuit for routing received radio frequency signals to the single antenna input of the recreational receiver;

a first electronic switch for passing the radio frequency signals received by said first antenna to said impedance matching and signal routing circuit in response to said AM-FM switch being in said first position and blocking said radio frequency signals received by said first antenna in response to said AM-FM switch being in said second position; and a second electronic switch for passing to ground said radio frequency signals received by said second antenna when said AM-FM switch is in said first position and for passing to said impedance matching and signal routing circuit the radio frequency signals received by said second antenna when said AM-FM switch is in said second position.

20. The antenna system of claim 19 wherein said AM-FM recreational receiver includes a weather channel for receiving weather information transmitted at a predetermined RF frequency, said antenna system further including a third antenna tuned to said predetermined RF frequency connected to said second electronic switch.

21. The antenna system of claim 20 wherein said first antenna is an electrically shielded loop antenna responsive to magnetic fields of the AM radio frequency signals and said second and third antennas are dipole antennas primarily responsive to the electric fields of the FM and weather band radio frequency signals.

22. The antenna system of claim 19 wherein said AM-FM recreational receiver generates a tuning signal having a value corresponding to the AM frequency to which said AM-FM recreational receiver is tuned, said antenna system having means for tuning said first antenna to the same AM frequency to which said AM-FM recreational receiver is tuned in response to the value of said tuning signal.

* * * * *

UNITED STATES PATENT AND TRADEMARK OFFICE

CERTIFICATE OF CORRECTION

PATENT NO. : 4,827,275

DATED : May 2, 1989

INVENTOR(S) : Richard Fusinski

It is certified that error appears in the above-identified patent and that said Letters Patent is hereby corrected as shown below:

Column 6. line 45. after "the" (first occurrence) insert ---- bypass ----.

Column 10. line 27. delete "to" (second occurrence) and insert ---- is ----.

Column 10. line 36. delete "ratio" and insert ---- radio ----.

Column 10. line 37. after "corresponding" insert ---- to ----.

Signed and Sealed this

Twenty-fourth Day of April, 1990

*Attest:*

HARRY F. MANBECK, JR.

*Attesting Officer*

*Commissioner of Patents and Trademarks*